US012233443B2

(12) United States Patent
Hackl et al.

(10) Patent No.: US 12,233,443 B2
(45) Date of Patent: Feb. 25, 2025

(54) SIX-HIGH ROLLING MILL STAND AND FINISHING MILL TRAIN FOR HOT ROLLING AN INTERMEDIATE STRIP INTO A THIN STRIP

(71) Applicant: Primetals Technologies Austria GmbH, Linz (AT)

(72) Inventors: Manfred Hackl, Lichtenberg (AT); Kenji Horii, Hiroshima (JP); Alois Seilinger, Linz (AT); Tatsunori Sugimoto, Hiroshima (JP); Roman Winkler, Altenberg (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 0 days.

(21) Appl. No.: 18/291,192

(22) PCT Filed: Jul. 21, 2022

(86) PCT No.: PCT/EP2022/070546
§ 371 (c)(1),
(2) Date: Jan. 22, 2024

(87) PCT Pub. No.: WO2023/001985
PCT Pub. Date: Jan. 26, 2023

(65) Prior Publication Data

US 2024/0359224 A1 Oct. 31, 2024

(30) Foreign Application Priority Data

Jul. 23, 2021 (EP) ..... 21187459

(51) Int. Cl.
*B21B 1/46* (2006.01)
*B21B 13/02* (2006.01)
(Continued)

(52) U.S. Cl.
CPC ..... *B21B 13/02* (2013.01); *B21B 1/46* (2013.01); *B21B 15/0085* (2013.01);
(Continued)

(58) Field of Classification Search
CPC ... B22D 11/1206; B22D 11/1287; B21B 1/46; B21B 1/463; B21B 1/466; B21B 13/142; B21B 29/00
See application file for complete search history.

(56) References Cited

U.S. PATENT DOCUMENTS 5,007,273 A 4/1991 Kummerhoff
5,234,154 A 8/1993 Kajiwara et al.
(Continued)

FOREIGN PATENT DOCUMENTS

EP 0411516 A2 2/1991
EP 0510713 A1 10/1992
(Continued)

OTHER PUBLICATIONS

International Search Report mailed Oct. 21, 2022 in corresponding PCT International Application No. PCT/EP2022/070546.

*Primary Examiner* — Kevin E Yoon
(74) *Attorney, Agent, or Firm* — OSTROLENK FABER LLP

(57) ABSTRACT

A six-high rolling (also known as sexto) mill stand that is suited for hot rolling an intermediate strip into a thin strip that is less than 0.8 mm thick. A combined casting and rolling installation that includes the six-high rolling mill stand allowing for hot rolling in long uninterrupted sequences, without any change of the work rolls to obtain a strip with good geometry due to moderate rolling forces.

20 Claims, 5 Drawing Sheets

(51) Int. Cl.

| | |
|---|---|
| ***B21B 15/00*** | (2006.01) |
| ***B21B 37/42*** | (2006.01) |
| ***B21B 37/44*** | (2006.01) |
| ***B22D 11/12*** | (2006.01) |
| ***B22D 11/128*** | (2006.01) |
| *B21B 45/02* | (2006.01) |

(52) U.S. Cl.

CPC ..... *B21B 37/42* (2013.01); *B21B 37/44* (2013.01); *B22D 11/1206* (2013.01); *B22D 11/1287* (2013.01); *B21B 2013/025* (2013.01); *B21B 2013/028* (2013.01); *B21B 2015/0057* (2013.01); *B21B 45/0233* (2013.01); *B21B 2201/14* (2013.01); *B21B 2261/04* (2013.01); *B21B 2261/20* (2013.01); *B21B 2267/06* (2013.01); *B21B 2269/04* (2013.01); *B21B 2269/06* (2013.01); *B21B 2269/10* (2013.01); *B21B 2269/14* (2013.01); *B21B 2269/16* (2013.01)

(56) References Cited

U.S. PATENT DOCUMENTS

| | | | | |
|---|---|---|---|---|
| 5,622,073 | A | 4/1997 | Hiruta et al. | |
| 7,004,002 | B2 | 2/2006 | Nishi et al. | |
| 7,963,136 | B2 | 6/2011 | Flick et al. | |
| 9,296,027 | B2 | 3/2016 | Eckerstorfer et al. | |
| 11,097,323 | B2 | 8/2021 | Vignolo et al. | |
| 2017/0008055 | A1* | 1/2017 | Norikura | B21B 37/58 |

FOREIGN PATENT DOCUMENTS

| | | | | | |
|---|---|---|---|---|---|
| EP | 1228818 | A2 | * | 8/2002 | B21B 37/40 |
| EP | 2441540 | A1 | | 4/2012 | |
| JP | 54013443 | A | * | 1/1979 | B21B 13/142 |
| JP | 07308701 | A | * | 11/1995 | B21B 1/26 |
| WO | WO 2006042606 | A1 | | 4/2006 | |
| WO | WO-2011003580 | A1 | * | 1/2011 | B21B 13/14 |
| WO | WO 2018/167711 | A1 | | 9/2018 | |

* cited by examiner

SIX-HIGH ROLLING MILL STAND AND FINISHING MILL TRAIN FOR HOT ROLLING AN INTERMEDIATE STRIP INTO A THIN STRIP

CROSS-REFERENCE TO RELATED APPLICATIONS

The present application is a 35 U.S.C. §§ 371 national stage application of International Application No. PCT/EP2022/070546, filed Jul. 21, 2022, which claims priority to European Patent Application No. 21187459.9, filed Jul. 23, 2021, the contents of which are incorporated herein by reference.

TECHNICAL FIELD

The invention concerns a six-high rolling mill stand (also known as sexto rolling mill stand) for hot rolling an intermediate strip into a thin strip and a method for producing a thin strip in a combined casting and rolling installation, wherein the thickness of the thin strip is <0.8 mm.

According to a first aspect of the invention, the invention concerns a six-high rolling mill stand for hot rolling an intermediate strip into a thin strip, the rolling mill stand comprising: an upper work roll and a lower work roll for hot rolling the intermediate strip between the upper work roll and the lower work roll into the thin strip; work roll bending blocks for bending the work rolls in vertical direction; two axial shifting devices for axially shifting the work rolls; two intermediate rolls for supporting the work rolls in vertical direction; intermediate roll bending blocks for bending the intermediate rolls in vertical direction; and two backup rolls for supporting the intermediate rolls in vertical direction.

According to a second aspect of the invention, the invention concerns a method for producing a thin strip in a combined casting and rolling installation, wherein the thickness of the thin strip is <0.8 mm, comprising the following steps: continuous casting a steel strand with slab or thin-slab format in a continuous casting machine; liquid-core reduction and/or soft-core reduction of the steel strand in the strand guide of the continuous casting machine, wherein the thickness of the steel strand is reduced by at least 5%; roughing rolling of the reduced steel strand to an intermediate strip in a roughing mill train, wherein the thickness of the intermediate strip is between 8 and 45 mm; finishing rolling the intermediate strip into the thin strip in a finishing mill train; measuring the profile and/or the flatness of the thin strip, wherein the measurement device is arranged in the transport direction of the strip between the last mill stand of the finishing mill train and the first cooling header of a cooling line; cooling of the thin strip to coiling temperature in the cooling line; and coiling of the cooled thin strip.

BACKGROUND ART

WO2017/215595 discloses a four-high rolling mill stand (also known as quarto rolling mill stand) for hot rolling an intermediate strip into a thin strip, the rolling mill stand comprising: an upper work roll and a lower work roll for hot rolling the intermediate strip between the upper work roll and the lower work roll into the thin strip, wherein each work roll features a cylindrical portion, in axial direction followed by a running surface, and followed by a tapered portion, wherein the upper work roll is arranged in an opposite direction to the lower work roll; and two axial shifting devices for shifting the work rolls in opposite axial directions. In addition, the document discloses a method for producing a thin strip in a combined casting and rolling installation, comprising the following steps: continuous casting a steel strand with slab or thin-slab format in a continuous casting machine; roughing rolling of the reduced steel strand to an intermediate strip in a roughing mill train; finishing rolling the intermediate strip into the thin strip in a finishing mill train; cooling of the thin strip to coiling temperature in a cooling line; and coiling of the cooled thin strip. Although the rolling mill of WO2017/215595 is suitable for hot rolling long uninterrupted sequences without any change of the work rolls, the rolling forces become very high when producing ultra-thin strip with a thickness<0.8 mm.

EP3595822 discloses a six-high rolling mill stand for hot rolling an intermediate strip into a thin strip, the rolling mill stand comprising: an upper work roll and a lower work roll for hot rolling the intermediate strip between the upper work roll and the lower work roll into the thin strip; two intermediate rolls for supporting the work rolls in the vertical direction; and two backup rolls for supporting the intermediate rolls in the vertical direction. In addition, the document discloses a method for producing a thin strip in a combined casting and rolling installation, wherein the thickness of the thin strip is ≤0.8 mm, comprising the following steps: continuous casting a steel strand with slab or thin-slab format in a continuous casting machine; roughing rolling of the reduced steel strand to an intermediate strip in a roughing mill train, wherein the thickness of the intermediate strip is between 8 and 40 mm; finishing rolling the intermediate strip into the thin strip in a finishing mill train; cooling of the thin strip to coiling temperature in the cooling line; and coiling of the cooled thin strip. Although the rolling mill of EP3595822 is suitable for producing ultra-thin strip with a thickness<0.8 mm, the solution is not suitable for hot rolling long uninterrupted sequences without any change of the work rolls.

U.S. Pat. No. 5,622,073 discloses a six-high rolling mill stand for hot rolling an intermediate strip into a strip, the rolling mill stand comprising:

- an upper work roll and a lower work roll for hot rolling the intermediate strip between the upper work roll and the lower work roll into the strip,
- work roll bending blocks for bending the work rolls;
- two axial shifting devices for axially shifting the work rolls;
- two intermediate rolls for supporting the work rolls in vertical direction, wherein each intermediate roll features an "S" shaped roll crown;
- intermediate roll bending blocks for bending the intermediate rolls; and
- two backup rolls for supporting the intermediate rolls in vertical direction.

It is noted that the S shaped roll crown of the intermediate rolls follows an odd function with respect to the centre of the intermediate roll in the width direction. In other words, the contour of the rolls is asymmetric with respect to the center of the rolls. During rolling, the intermediate rolls are axially shifted in order to control the profile of the strip.

WO2018/167711 discloses a method for producing thin strip in a combined casting and rolling installation, wherein the thickness of the thin strip is <0.8 mm, comprising the following steps:

- continuous casting a steel strand in a continuous casting machine;

roughing rolling of the steel strand to an intermediate strip in a roughing mill train, wherein the thickness of the intermediate strip is between 8 and 45 mm;

heating the intermediate strip;

finishing rolling the intermediate strip into the thin strip in a finishing mill train, wherein firstly five reduction steps are performed by four-high mill stands, and secondly, two reduction steps are performed subsequently by six-high mill stands;

cooling of the thin strip in a cooling line; and coiling of the cooled thin strip.

Although six-high rolling mill stands are known in the prior art, the known mill stands are either not suitable for hot rolling long uninterrupted sequences, particularly in endless mode, without any change of the work rolls, or the mill stands are not optimally suited for producing ultra-thin strip with a thickness<0.8 mm.

SUMMARY OF INVENTION

It is the primary object of the invention to come up with a six-high rolling mill stand that is suitable for hot-rolling of ultra-thin steel strip with a thickness<0.8 mm, say 0.6 mm and below, in a combined casting and rolling installation, whereby the hot rolling can be done in long uninterrupted sequences, particularly in endless mode, without any change of the work rolls, and very good geometry of the thin strip due to moderate rolling forces.

Another object of the invention is to come up with a method for producing an ultra-thin steel strip in a combined casting and rolling installation with low production costs and very good geometry.

The first object of the invention is solved by a six-high rolling mill stand for hot rolling an intermediate strip into a thin strip, preferably having a thickness<0.8 mm, according to claim 1, the rolling mill stand comprising:

an upper work roll and a lower work roll for hot rolling the intermediate strip between the upper work roll and the lower work roll into the thin strip;

work roll bending blocks for bending the work rolls in vertical direction;

two axial shifting devices for axially shifting the work rolls;

two intermediate rolls for supporting the work rolls in vertical direction, wherein each intermediate roll has a first tapered portion, in axial direction followed by an intermediate portion, and followed by a second tapered portion, wherein the roll crown of the intermediate portion follows an even function with respect to the centre of the intermediate portion in width direction, wherein each tapered portion features a large diameter adjacent to the intermediate portion and a comparatively smaller diameter outside;

intermediate roll bending blocks for bending the intermediate rolls in vertical direction; and two backup rolls for supporting the intermediate rolls in vertical direction.

Due to the six-high arrangement of the rolling mill stand, the running surface of the work rolls may have a small diameter, e.g. between 300 and 500 mm, resulting in low rolling forces and a good geometry of the resulting thin strip. The geometry, i.e. the profile and flatness, of the thin strip can be adjusted by both the work roll bending blocks for bending the work rolls in vertical direction and the intermediate roll bending blocks for bending the intermediate rolls in vertical direction. The combination of both bending the work rolls and bending the intermediate rolls results in a broad two-dimensional field that allows the effective adjustment of profile and flatness of the rolled ultrathin strip in a broad manner.

Compared to six-high rolling mill stands from the prior art, bending blocks for both the work rolls as well as for the two intermediate rolls are present. Typically, the upper work roll is bent by the work roll bending block in the upward vertical direction, whereas the lower work roll is bent by the work roll bending block in the downward vertical direction. The intermediate rolls may be bent in analogous directions by the intermediate roll bending blocks. Another significant difference to six-high rolling mill stands from the prior art is that each of the two intermediate rolls features a first tapered portion, in axial direction followed by an intermediate portion, and in axial direction followed by a second tapered portion. This in retrospect relatively simple modification of the intermediate roll's shape reduces the Hertz' stresses between the end regions of the running surface of the work rolls and the corresponding regions of the intermediate rolls significantly. As the edge regions in the width direction of the thin strip are most strongly affected by work roll wear, the special shape of the intermediate rolls reduces the work roll wear considerably.

The six-high rolling mill stand according to the invention can either feature a) work rolls having a conventional shape, i.e. featuring a running surface, and wherein the two axial shifting devices allow the typically cyclical shifting of the work rolls in the opposite or same axial direction, or b) preferably work rolls having a special shape, wherein each work roll features a cylindrical portion, in axial direction followed by a running surface, and in axial direction followed by a tapered portion, wherein the upper work roll is arranged in an opposite direction to the lower work roll, and wherein the two axial shifting devices allow the shifting of the work rolls in opposite axial directions.

The earlier mentioned embodiment has been known from conventional hot strip mills for a long time. The cyclical shifting of the work rolls aims to distribute the wear across the running surface of the work rolls.

The latter mentioned embodiment allows even longer uninterrupted rolling sequences due to the special shape of the work rolls, each roll having a cylindrical portion, a typically ground running surface, and a tapered portion, the opposite arrangement of the work rolls in the mill stand, and two long-stroke axial shifting devices for shifting the work rolls in opposite axial directions. The shifting of the work rolls in opposite axial directions (see WO 2017/215595) ensures that the wear of the work rolls has no or at least very little effect on the geometry of the thin strip. Such a six-high rolling mill stand is ideally suited for hot-rolling long uninterrupted sequences in a combined casting and rolling installation, e.g. an Arvedi ESP line.

According to the invention, each intermediate roll features a first tapered portion, in axial direction followed by an intermediate portion defining an even function with respect to the centre of the intermediate portion (or even the roll) in the width direction, and followed by a second tapered portion.

Each tapered portion features a large diameter adjacent to the intermediate portion (i.e. inside) and a comparatively smaller diameter on the outside of the tapered portion.

Contrary to the teaching of U.S. Pat. No. 5,622,073, the roll crown of the intermediate rolls according to the invention follows an even function, not an odd function. By doing so, the roll crown is symmetric with respect to center of the intermediate portion (or even the roll) in width direction. By having intermediate rolls with a symmetric roll crown, the deformation of the intermediate rolls due to rolling force and thermal deflection can be compensated by the intermediate roll bending blocks allowing the being of the intermediate rolls in vertical direction. The simplest contour of an intermediate rolls where the roll crown follows an even function is a cylindrical shape. However, other even shapes, such as a constant function $y=A$ with $A \in \mathbb{R}$, a parabola $y=A \cdot x^2$ or more generally following the function $y=A \cdot x^{2n}$ with $n \in N$, or following a cosine function $y=A \cdot \cos(x)$ . . . are possible.

In a preferred embodiment of the invention, the six-high rolling mill stand features two work roll cooling devices, one assigned to the upper work roll and the other assigned to the lower work roll, for the cooling of multiple, axially spaced cooling zones of the running surface of the work roll with adjustable cooling intensity. By doing so, the geometry, i.e. the profile and/or flatness, of the thin strip can be adjusted not only by bending the work rolls and the intermediate rolls, but also by cooling the running surface of the work rolls with adjustable cooling intensity. This allows an effective control of the geometry of the thin strip.

At least one, preferably two, work roll cooling device is present on the entry side of the rolling mill and at least one, preferably two or three, work roll cooling device is present on the exit side of the rolling mill.

The work roll cooling devices may either be shifted synchronously with the axial shifting of the work rolls or remain stationary in the axial direction. Particularly in the former case, it may be advantageous to use valves to switch off cooling zones which are no longer in contact with the strip.

According to a preferred embodiment, the number of multiple, axially spaced cooling zones is at least three, preferably at least five. For effectively controlling the geometry of the rolled strip, the number of cooling zones can be increased further, e.g. up to 29.

It is preferred to use work rolls having a diameter between 300 and 500 mm, and/or to use intermediate rolls having a diameter between 450 and 800 mm. The diameter of the work rolls directly influences the rolling force during hot rolling, wherein a small diameter results in a small rolling force and vice versa.

In order to "lock" the work-rolls and/or intermediate rolls in the vertical and horizontal direction, it is preferred that at least two stabilising devices are assigned to each work roll and/or intermediate roll. The locking can be done prior to the commencement of a rolling sequence, wherein the sequence can be conducted in endless, semi-endless or even batch rolling mode. By locking the rolls, shocks—e.g. a rapidly increasing rolling force at the beginning of the rolling sequence, do not result in a corresponding displacement of the roll in vertical and/or horizontal direction. In any case, such displacement will be a lot smaller.

A finishing mill train according to the invention comprises: two or three, preferably three, four-high mill stands, wherein each four-high mill stand features work roll bending blocks for bending the work rolls of the mill stand in vertical direction; two or three, preferably two, six-high rolling mill stands according to the invention, wherein the four-high mill stands are arranged in the transport direction of the strip before the six-high rolling mill stands.

As four-high mill stands are significantly simpler and cheaper than six-high rolling mill stands, it makes sense to use four-high mill stands at the beginning of the finishing mill train and to use six-high mill stands towards the end of the finishing mill train. In a preferred embodiment, all four-high mill stands are comprised in a first group and all six-high mill stands are comprised in a second group, wherein the $1^{st}$ group is arranged ahead of the $2^{nd}$ group.

In a more preferred embodiment of the invention, between the last mill stand of the finishing mill train and the first cooling header of the cooling line a measurement device for measuring the profile and/or the flatness of the thin strip is arranged. The measurement device allows quality control of the rolled thin strip and—as may be seen below—can be used to feed measurement data into a controller in order to control the geometry of the thin strip in the finishing mill train.

According to an even more preferred embodiment, the finishing mill train features a controller for controlling the profile and/or flatness of the thin strip, wherein the controller is connected to the measurement device for measuring the profile and/or the flatness of the thin strip, the work roll bending blocks of the four-high mill stands of the finishing mill train, the work roll bending blocks and the intermediate roll bending blocks of the six-high mill stands of the finishing mill train, and preferably the work roll cooling devices for cooling multiple, axially spaced cooling zones of the running surface of a work roll with adjustable cooling intensity.

The second object of the invention is solved by a method for producing a thin strip in a combined casting and rolling installation, wherein the thickness of the thin strip is <0.8 mm, comprising the following steps:

- continuous casting a steel strand with slab or thin-slab format in a continuous casting machine,
- liquid-core reduction and/or soft-core reduction of the steel strand in the strand guide of the continuous casting machine, wherein the thickness of the steel strand is reduced by at least 5%,
- roughing rolling of the reduced steel strand to an intermediate strip in a roughing mill train, wherein the thickness of the intermediate strip is between 8 and 45 mm,
- optionally heating the intermediate strip to a surface temperature between 900 and 1200° C.,
- finishing rolling the intermediate strip into the thin strip in a finishing mill train, wherein firstly two or three, preferably three, reduction steps are performed subsequently by four-high mill stands, and secondly, two or three, preferably two, reduction steps are performed subsequently by six-high mill stands, wherein the finishing mill train is preferably according to one of the claims 8 to 10,
- measuring the profile and/or the flatness of the thin strip, wherein the measurement device is arranged in the transport direction of the strip between the last mill stand of the finishing mill train and the first cooling header of a cooling line,
- cooling of the thin strip to coiling temperature in the cooling line, and
- coiling of the cooled thin strip.

In the combined casting and rolling installation, a continuous casting machine continuously casts liquid steel into a steel strand with slab or thin-slab format. By reducing the thickness of the steel strand by a liquid-core and/or soft-core reduction in the strand guide of the casting machine, the metallurgical quality of the steel strand is improved, the thickness is reduced and the speed of the steel strand is increased. The so-called liquid-core reduction reduces the thickness of the strand when the centre of the strand is still liquid; likewise the so-called soft-core reduction reduces the thickness of the strand when the centre of the strand is still mushy, i.e. no longer liquid and not yet fully solidified. After the liquid-core and/or soft-core reduction, the thickness of the strand is reduced further by roughing rolling to an intermediate strip with a thickness between 8 and 45 mm. The roughing rolling is typically done by two, three or four roughing stands. In order to reach a specific, e.g. austenite or ferrite, grain in the thin strip, the last reduction step in the finishing mill train needs to be performed at a specific temperature. Depending on the length of the combined casting and rolling installation, the casting speed etc. the surface temperature of the intermediate strip may be heated to a temperature between 900 and 1200° C. The heating may be done by induction heating preferably. In any case, the intermediate strip is finish rolled into the thin strip in a finishing mill train, wherein the first two or three, preferably three, reduction steps are performed subsequently by four-high mill stands, and after this, two or three, preferably two, reduction steps are performed subsequently by six-high mill stands. The six-high mill stands is preferably according to one of the claims 8 to 10. After hot rolling and before cooling the thin strip to coiling temperature, the profile and/or the flatness of the thin strip is measured by a measurement device. Finally, the cooled thin strip is coiled.

According to a first preferred embodiment, the roughing rolling is performed on the uncut steel strand, the finishing rolling is performed on the uncut intermediate strip, preferably the cooling is performed on the uncut thin strip, and the thin strip is cut before the coiling of the cooled thin strip.

This embodiment is particularly suitable for traditional combined casting and rolling installations, wherein the continuous casting machine, the roughing mill train, the finishing mill train, the cooling line and the coilers are aligned in-line. The endless operation of the casting and rolling installation allows the production of ultra-thin steel strip without the risk of cobbles in the line due to strip heads moving with high speed and getting caught by auxiliary devices. Due to the endless operation, no strip heads are present and in the steel strand, the intermediate strip and the thin strip some tension is present, such that a "flying strip head" cannot occur.

According to a second preferred embodiment, the steel strand is cut to slabs before roughing rolling, the slabs are roughing rolled into intermediate strips, the intermediate strips are joined together before finishing rolling, the finishing rolling is performed on the joined intermediate strips, preferably the cooling is performed on the uncut thin strip, and the thin strip is cut before the coiling of the cooled thin strip.

This embodiment allows the production of 4 million metric tons/year on a single casting and rolling installation having more than 1 continuous casting machine. Also in this case, the finishing rolling and the cooling take place in an uncut fashion, whereby the risk of a "flying strip head" is greatly reduced.

In another preferred embodiment of the invention, the profile and/or the flatness of the thin strip is controlled by a controller taking into account the measured profile and/or flatness of the thin strip by setting the bending of the work rolls of the four-high mill stands of the finishing mill train, the bending of both the work rolls and the intermediate rolls of the six-high mill stands of the finishing mill train, and preferably the cooling of multiple, axially spaced cooling zones of the running surface of the work rolls of the six-high mill stands of the finishing mill train with a pre-set cooling intensity.

BRIEF DESCRIPTION OF DRAWINGS

Further advantages and features of the present invention are provided by the following description of non-restrictive exemplary embodiments, wherein the figures show.

DESCRIPTION OF EMBODIMENTS

Figure 1:
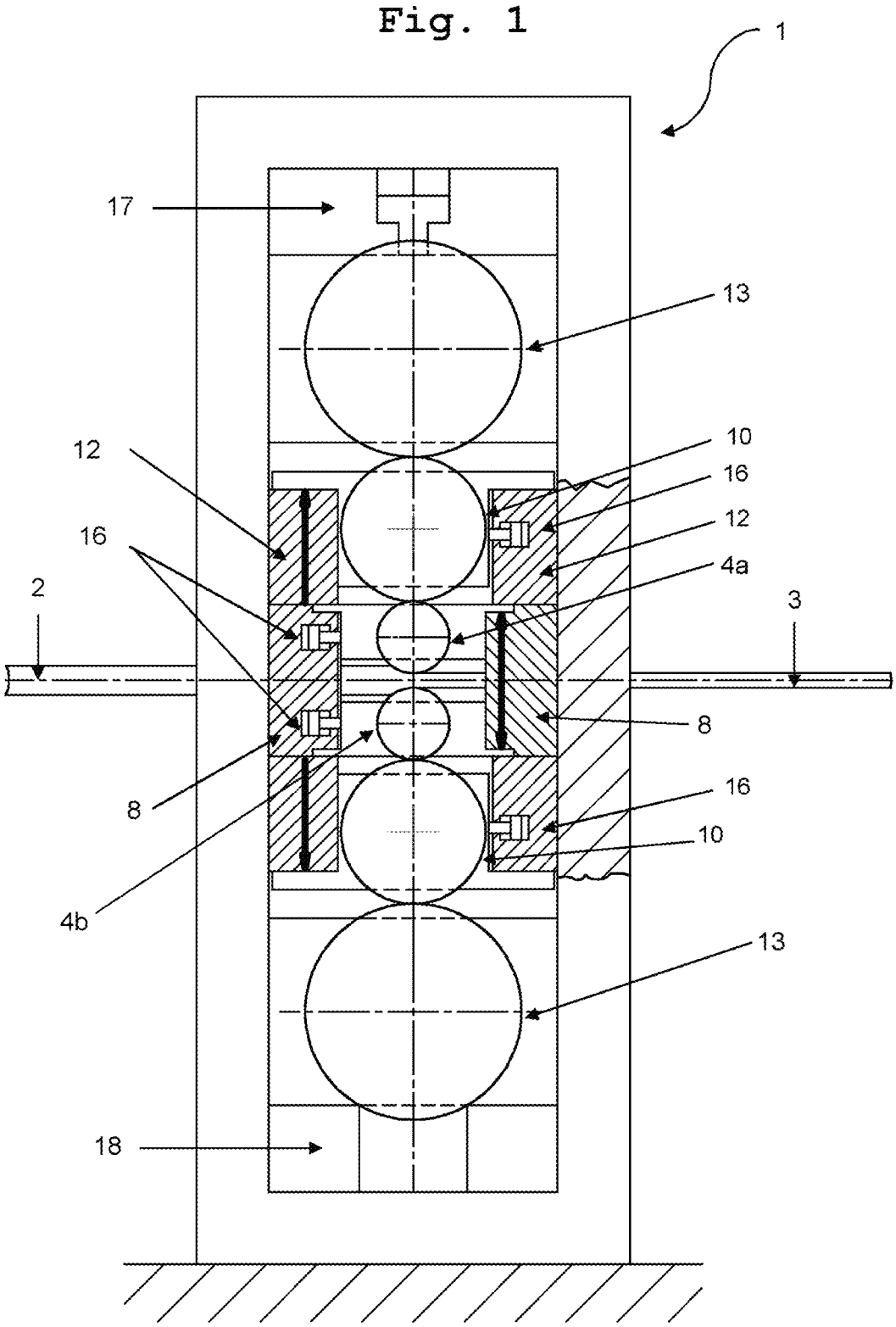
FIG. 1 a schematic showing a six-high rolling mill stand according to the invention in a partially cut front view, FIG. 2 a schematic showing the work, intermediate and backup rolls of the six-high rolling mill stand of FIG. 1, FIG. 3 a schematic showing the upper work roll, the upper intermediate roll, and the upper backup roll of FIG. 2 separately in greater detail, FIG. 4 a diagram showing the control range in a 4-high rolling mill stand according to the prior art and a 6-high rolling mill stand according to the invention, FIGS. 5*a* and 5*b* a schematic showing the work roll cooling device for cooling multiple, axially separated cooling zones of the work roll, FIG. 6 a diagram showing the specific flow rates of the work roll cooling device of FIGS. 5*a* and 5*b* in the width direction of the work roll, and FIG. 7 a schematic showing a combined casting and rolling line having two six-high rolling stands in the finishing rolling train.

FIG. 1 shows a schematic front view of a six-high rolling mill stand 1 according to the invention for hot rolling an intermediate strip 2 into a thin strip 3. The intermediate strip 2 is hot rolled between the rolling gap between the upper work roll 4*a* and the lower work roll 4*b*. The work rolls 4*a*, 4*b* are journaled in roll chocks and may be bent by two work roll bending blocks 8. The work roll bending block 8 on the entry side of the mill stand 1 features two stabilizing devices 16 for locking the work rolls 4*a*, 4*b* during hot rolling. The work rolls 4*a*, 4*b* are supported by two intermediate rolls 10 in the mill stand. Also the intermediate rolls 10 are journaled in roll chocks and may be bent by four intermediate roll bending blocks 12. The bending forces from the work roll bending blocks 8 and the intermediate roll bending blocks 12 are shown by arrows on the exit side and on the entry side of the mill stand 1, respectively. For reasons of clarity, the bending forces are shown on one side of the mill stand 1 only, although they are present on both sides. The intermediate rolls 10 are supported by two so-called backup rolls 13 in the mill stand. Also the backup rolls 13 are journaled in roll chocks, however, no bending blocks for bending the backup rolls 13 are present. In order to change the rolling gap between the upper and the lower work roll 4*a*, 4*b*, one hydraulic cylinder 17 is present to move the roll chocks journaling the backup rolls 13 in the mill stand 1. The pass line level of the work roll 4*b* is set by the pass line adjusting device 18. As the backup rolls 13 are in contact with the intermediate rolls 10 and the intermediate rolls 10 are in contact with the work rolls 4*a*, 4*b*, the rolling gap is changed by the hydraulic cylinder 17. As depicted in FIG. 1, stabilizing devices 16 are present on the exit side of the mill stand 1 between the intermediate roll bending blocks 12 and the roll chocks. It is possible that further stabilizing devices 16 are present on the entry side of the mill stand and between the roll chocks and work roll bending blocks 8.

Figure 2:
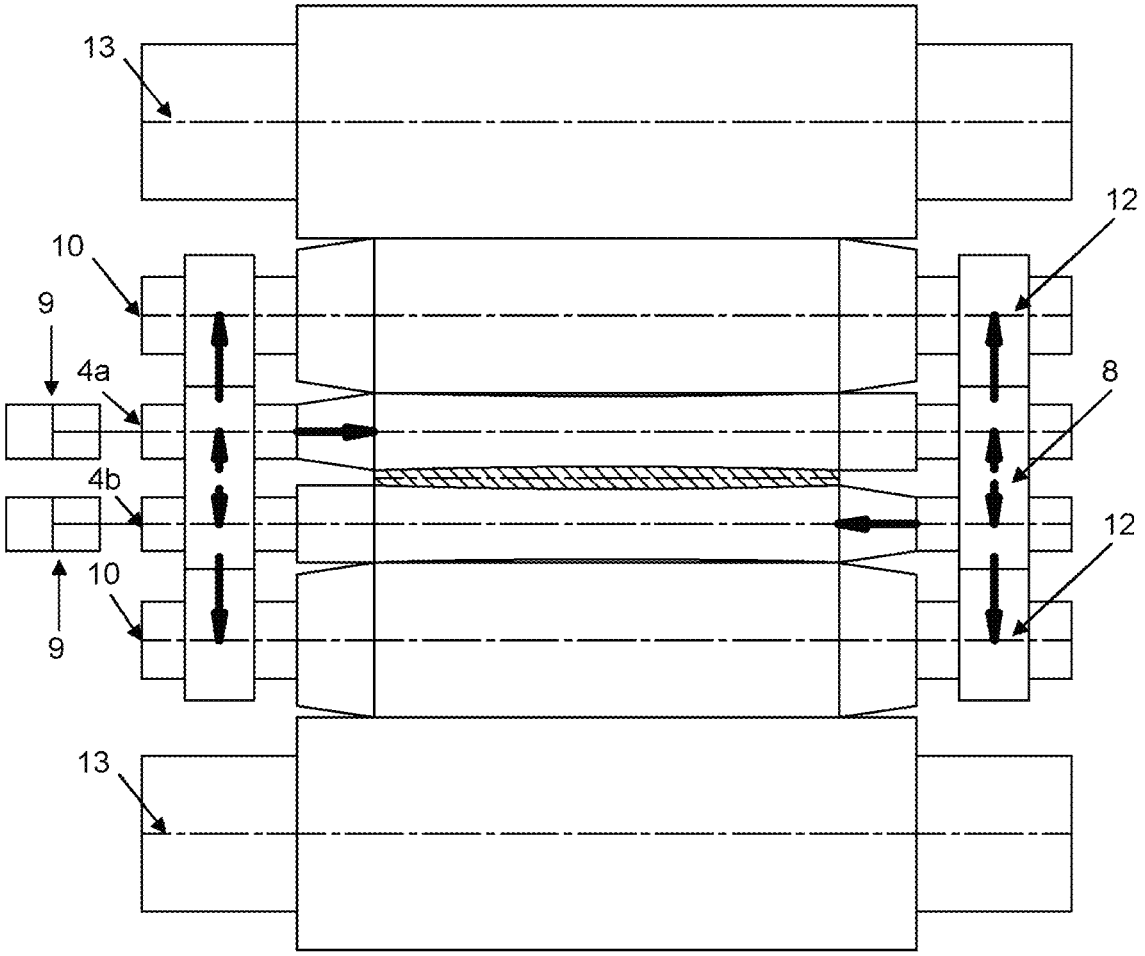

The work rolls 4*a*, 4*b* and the work roll bending blocks 8, the intermediate rolls 10 and the intermediate bending blocks 12, the backup rolls 13 and the axial shifting devices 9 are shown again in FIG. 2 in a side view. It is immediately apparent that each work roll 4*a*, 4*b* features a tapered section, followed by a typically ground running surface, and a cylindrical surface. The upper work roll 4*a* is arranged opposite to the lower work roll 4*b*. Both work rolls 4*a*, 4*b* are connected to a respective separate axial shifting device 9 that allows the shifting of the work rolls 4*a*, 4*b* in opposite horizontal directions, i.e. the upper work roll 4*a* to the right and the lower work roll 4*b* to the left (see horizontal arrows). The work roll bending blocks 8 and the intermediate bending blocks 12 are shown schematically.

Figure 3:
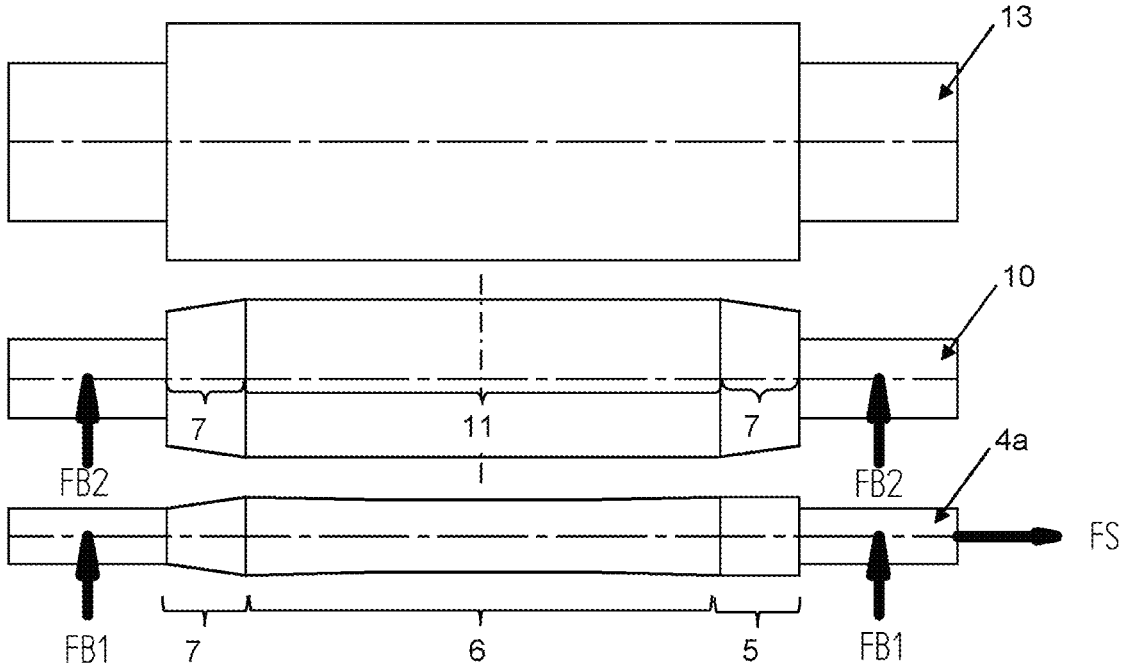

The different portions of the work rolls 4*a*, 4*b*, the intermediate rolls 10 and the backup rolls 13 are depicted in FIG. 3. Each work roll 4*a*, 4*b* features a tapered portion 7, in axial direction followed by a running surface 6 and a cylindrical portion 5. Each intermediate roll 10 features two tapered portions 7, having a small diameter outside and a comparatively larger diameter further inside, and an intermediate portion 11 in-between. The contour of the intermediate portions 11 follows an even function with respect to the center of the intermediate portion (and even of the intermediate roll 11 itself) in the width direction. The centre of the intermediate portion 11 in width direction is indicated by a dash-dotted line. In this case, the even function is a cylindrical shape of the intermediate portion 11. The bending forces FB1 acting on the upper work roll 4*a* and the bending forces FB2 acting on the intermediate roll 10 as well as the force FS shifting the work roll 4*a* in a horizontal, axial direction are depicted by arrows.

Figure 4:
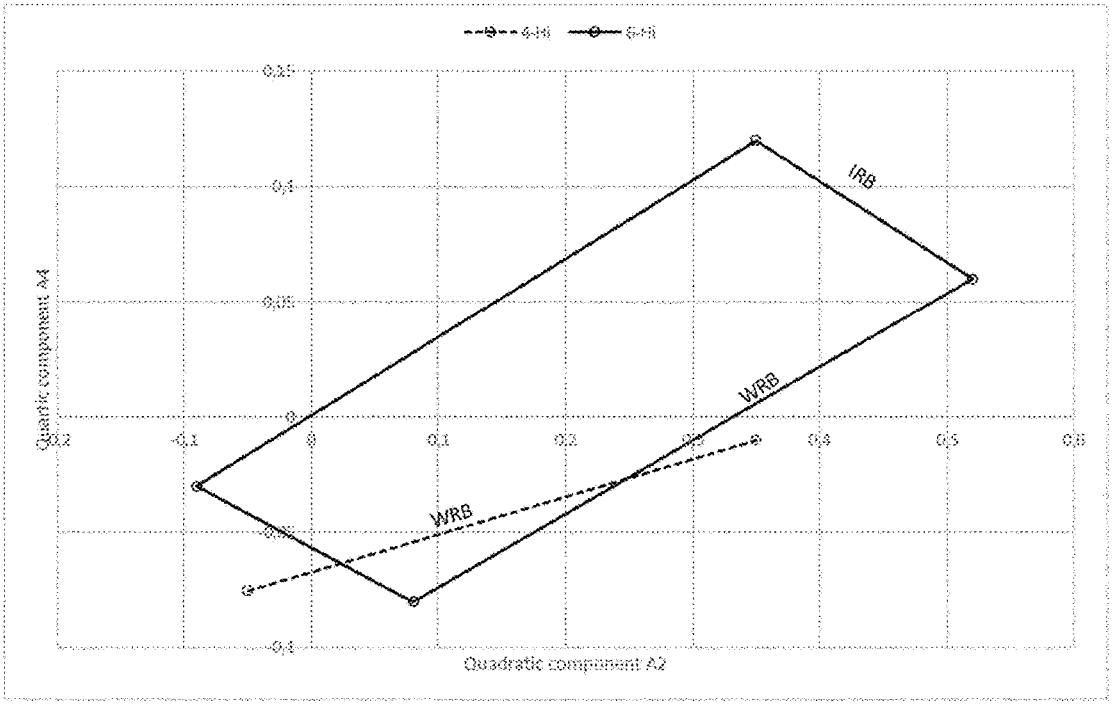

In FIG. 4 the control range of the work roll bending blocks 8 and the intermediate bending blocks 12 depicted in FIGS. 1 and 2 of a six-high rolling mill stand according to the invention are compared to the control range of the work roll bending block 8 for a 4-high rolling mill stand. It is evident that the combination of the work roll bending blocks (in the diagram labelled WRB) with the intermediate roll bending blocks (short IRB) results in a much wider control range for both the quadratic component A2 and the quartic component A4. The six-high rolling mill stands 1 according to the invention are therefore superior to 4-high rolling mill stands in terms of geometry control of the rolled thin strip.

Figure 5A:
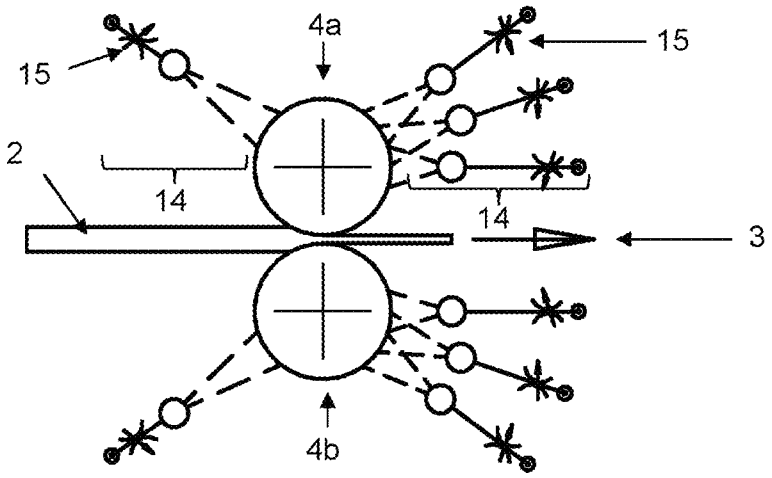
Figure 5B:
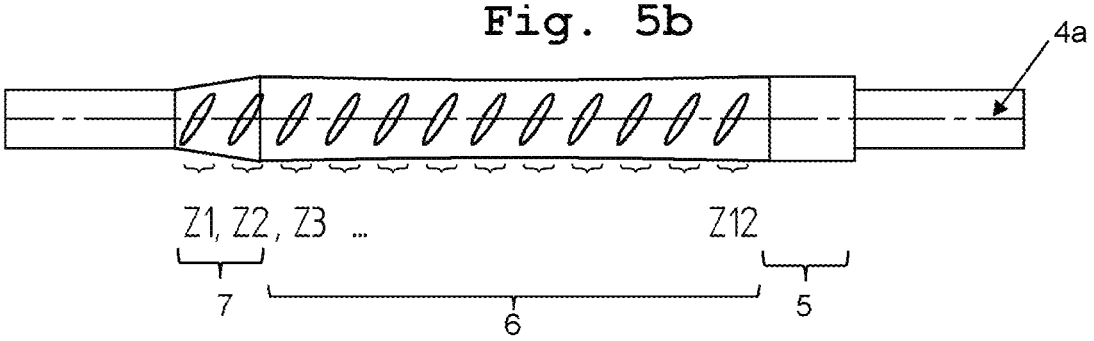

FIGS. 5*a* and 5*b* depict the upper and lower work rolls 4*a*, 4*b* of the six-high rolling mill stand with one work roll cooling device 14 on the entry and three work roll cooling devices 14 on the exit side of the mill stand per work roll, respectively. For sake of conciseness, the intermediate rolls and the backup rolls are not depicted in these FIGS. On the entry side of the mill stand, one work roll cooling device 14 is present per work roll. This work roll cooling device 14 allows the individual cooling of 12 axially spaced cooling zones Z1 . . . Z12 of the running surface 6 of the work roll 4*a*, 4*b* (see FIG. 5*b*). In other words, the cooling intensity of each zone Z1 . . . Z12 may be adjusted independently by a separate valve 15. The valve 15 can either adjust the pressure of the cooling fluid, which consequently changes the flow rate through the spraying nozzle or change the opening time in which the valve 15 is fully open. The change of the opening time also adjusts the total amount of the cooling fluid passing through the spraying nozzle per cycle (see so-called pulse width modulation, short PWM). On the exit side of the mill stand, three work roll cooling devices 14 are present. Each work roll cooling device 14 again features at least one valve 15 for setting the effective flow rate through the cooling nozzle.

With respect to FIG. 5*b* it is noted that according to a simple first embodiment of the invention, it is in most cases sufficient that the cooling zones cover the running surface 6 of the work rolls 4*a*, 4*b* only, and possibly some overlap with the tapered portion and/or the cylindrical portion of the work rolls exists. Therefore, e.g. only the cooling zones Z3 . . . Z12 depicted in FIG. 5*b* are switched on. In this case, the cooling devices 14 remain stationary even though the work rolls 4*a*, 4*b* may be shifted in an axial direction. According to an alternative embodiment of the invention, the cooling devices 14 do not remain stationary and are shifted axially synchronously with the respective work rolls. The shifting of the cooling devices 14 can take place by either the long stroke axial shifting devices shifting the work rolls, or by separate axial shifting devices. In either case, it is advantageous that the cooling zones cover both the tapered portion 7 and the running surface 6 of the work rolls. At the beginning of a rolling sequence, only the cooling zone Z3 . . . Z12 are switched on and the valves 15 for the cooling zones Z1 and Z2 are closed. Towards the end of the rolling campaign and as the upper work roll 4*a* is shifted to the right during rolling, the zones Z1 . . . Z10 are switched on and the valves 15 for zones Z11 and Z12 are shut off. By doing so, the regions of the work rolls contacting the strip are cooled at all times.

Figure 6:
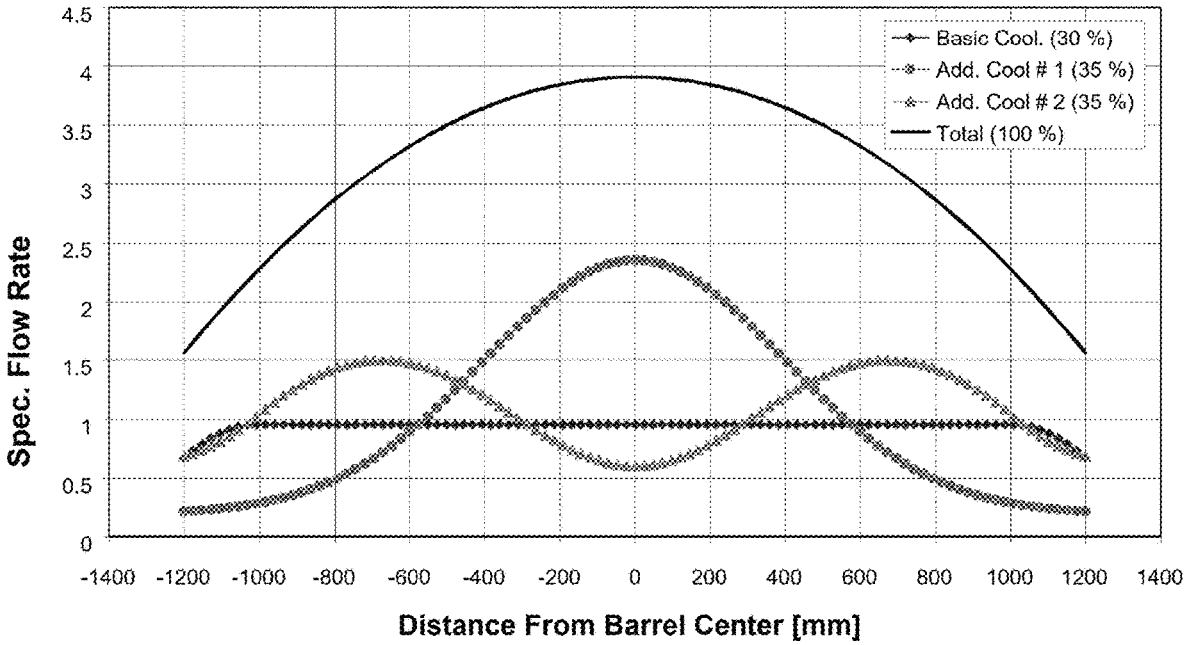

FIG. 6 shows the specific flow rates of the three work roll cooling devices 14 located on the exit side of the mill stand of FIG. 5. One of the work roll cooling devices 14 supplies the basic cooling of the work roll, amounting to 30% of the max. total cooling intensity. The basic cooling is almost constant across the width of the work roll, falling to some 70% at the edges. The additional cooling #1 amounts to 35% of the max. total cooling intensity and follows a cosine function with its peak at the centre of the barrel. The additional cooling #2 also amounts to 35% of the max. total cooling intensity and follows a negative cosine function with its minimum at the centre of the barrel. The frequency of the additional cooling function #2 is twice the frequency of the additional cooling function #1. Assuming that all three work roll cooling devices 14 operate at maximum flow, the max. cooling intensity is at the centre of the barrel (flow rate almost 4) compared to a flow rate of 1.5 at the edges of the barrel.

The six-high rolling mill stand according to the invention is particularly advantageous for finishing rolling high quality ultra-thin steel strip with a final thickness after the last roll stand <0.8 mm, preferably s 0.6 mm. The diameter of the work rolls is typically between 300 and 500 mm and consequently considerably smaller than the diameter of work rolls in four-high mill stands. The smaller diameter results in a considerably smaller rolling force at the same ratio of thickness reduction. Due to the reduced rolling force, the geometrical properties, such as profile and/or flatness, of the thin steel strip are greatly improved. The application of six-high rolling mill stands is particularly advantageous as the third, fourth and/or fifth mill stand in a finishing mill train of a combined casting and hot rolling installation, where thin (or ultra-thin) steel strip is produced that may serve as substitute material for cold rolled steel strip.

Figure 7:
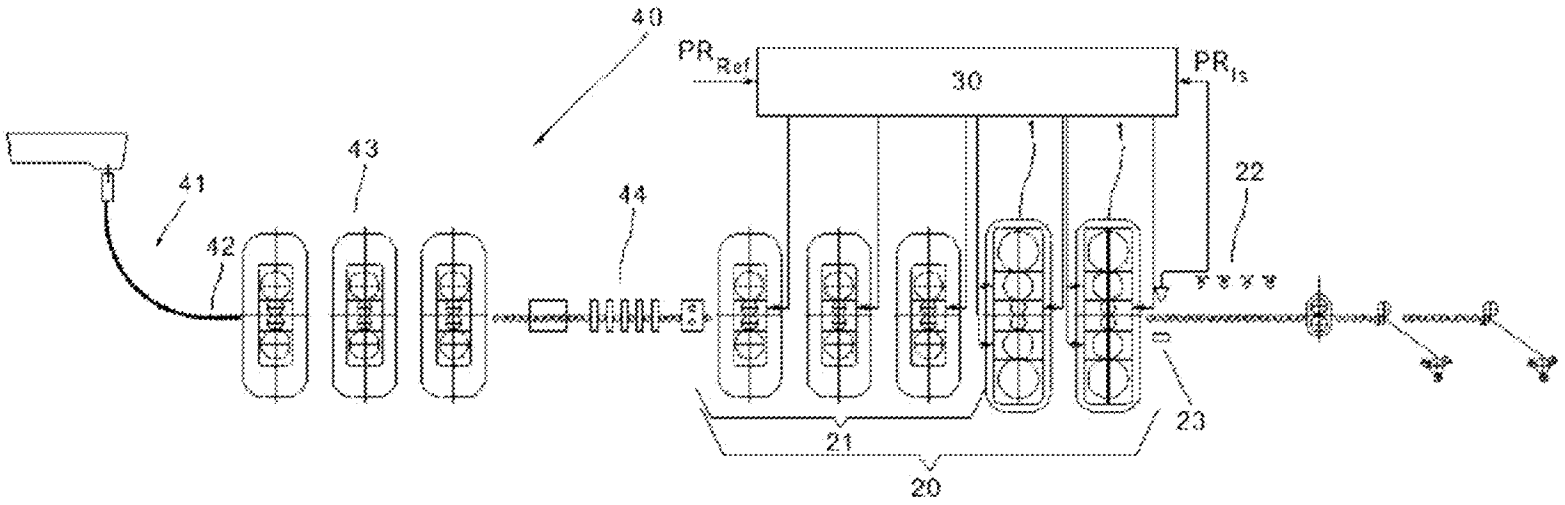

FIG. 7 shows a combined casting and hot rolling installation 40 featuring a continuous casting machine 41 with a bow-type strand guide 42, in which the strand coming from the mould is subjected to a liquid-core and/or a soft-core reduction. By doing so, the strand having a thickness of 110 mm immediately after the mould is reduced to a thickness of 100 mm at the end of the bow-type strand guide 42. The reduced strand is then rough rolled in a roughing mill train 43 to a so-called intermediate strip having a thickness of 16 mm. The temperature of the intermediate strip can be adjusted by a heater 44. After descaling the heated intermediate strip, the intermediate strip is finish rolled in a finishing mill train 20. The first to third rolling step in the finishing mill train 20 are done by 4-high mill stands 21, the fourth and the fifth rolling step are done by six-high rolling mill stands 1, respectively. The end thickness of the ultra-thin steel strip is 0.6 mm. All rolling steps both in the roughing mill train 43 and in the finishing mill train 20 are performed on the uncut strand/strip, i.e. in endless mode. After the finishing rolling, the profile and/or the flatness of the ultra-thin steel strip is measured by a measurement device 23. After that, the temperature of the steel strip is reduced to coiling temperature in the cooling line 22, the endless strip is cut to length/weight by shears and coiled by at least two coilers. In order to produce ultra-thin strip with top notch geometrical properties, the measurement device 23 continuously measures both the profile and the flatness of the thin steel strip and feeds the measurement data into a controller 30. As depicted, the controller 30 compares the measured profile of the thin strip $PR_{is}$ to the reference value for the thin strip $PR_{Ref}$ and creates control values for the work roll bending blocks of the 4-high rolling mill stands 21, the work roll bending blocks of the 6-high rolling mill stands 1 and the intermediate roll bending blocks of the 6-high rolling mill stands 1. By doing so, the geometric properties of the ultra-thin steel strip are equally good or at least almost comparable to cold rolled steel strip produced by state-of-the-art technologies.

Although the invention has been illustrated more specifically and described in detail by the preferred exemplary embodiments, the invention is not restricted by the examples disclosed and other variations can be derived therefrom by a person skilled in the art without departing from the scope of protection of the invention.

REFERENCE SIGNS LIST

1 Six-high rolling mill stand
2 Intermediate strip
3 Thin strip
4*a* Upper work roll
4*b* Lower work roll
5 Cylindrical portion
6 Running surface
7 Tapered portion
8 Work roll bending block
9 Axial shifting device
10 Intermediate roll
11 Intermediate portion
12 Intermediate roll bending block
13 Backup roll
14 Work roll cooling device
15 Valve
16 Stabilising device
17 Hydraulic cylinder
18 Pass line adjusting device
20 Finishing mill train
21 Four-high rolling mill stand
22 Cooling line
23 Measurement device
30 Controller
40 Combined casting and rolling installation
41 Continuous casting machine
42 Strand guide
43 Roughing mill train
44 Heater
FB1, FB2 Bending force
FS Displacement force
$PR_{is}$ Measured profile of the thin strip
$PR_{Ref}$ Reference value of the profile of the thin strip
Z1 . . . Z12 Axially spaced cooling zone

The invention claimed is:

1. Six-high rolling mill stand for hot rolling an intermediate strip into a thin strip, the rolling mill stand comprising:
an upper work roll and a lower work roll for hot rolling the intermediate strip between the upper work roll and the lower work roll into the thin strip,
work roll bending blocks for bending the work rolls in vertical direction;
two axial shifting devices for axially shifting the work rolls;
two intermediate rolls for supporting the work rolls in vertical direction
intermediate roll bending blocks for bending the intermediate rolls in vertical direction; and
two backup rolls for supporting the intermediate rolls in vertical direction,
wherein each intermediate roll has a first tapered portion, in axial direction followed by an intermediate portion, and followed by a second tapered portion,
wherein a roll crown of the intermediate portion follows an even function with respect to the centre of the intermediate portion fin width direction,
wherein each tapered portion features a large diameter adjacent to the intermediate portion and a comparatively smaller diameter on outside.

2. Six-high rolling mill stand according to claim 1,
wherein each work roll features a cylindrical portion, in axial direction followed by a running surface, and followed by a tapered portion,
wherein the upper work roll is arranged in an opposite direction to the lower work roll; and
wherein the two axial shifting devices allow the shifting the work rolls in opposite axial directions.

3. Six-high rolling mill stand according to claim 1, comprising at least two work roll cooling devices, wherein each work roll cooling device allows the cooling of multiple, axially spaced cooling zones (Z1 . . . Z12) of the running surface of a work roll with adjustable cooling intensity.

4. Six-high rolling mill stand according to claim 3, wherein the number of multiple, axially spaced cooling zones (Z1 . . . Z12) is at least three.

5. Six-high rolling mill stand according to claim 3, wherein the number of multiple, axially spaced cooling zones (Z1 . . . Z12) is at least five.

6. Six-high rolling mill stand according to claim 3, wherein the number of multiple, axially spaced cooling zones (Z1 . . . Z12) is at least nine.

7. Six-high rolling mill stand according to claim 1, wherein the diameter of a work roll is between 300 and 500 mm, and/or wherein the diameter of an intermediate roll is between 450 and 800 mm.

8. Six-high rolling mill stand according to claim 1, wherein at least two stabilising devices are assigned to each intermediate roll for stabilizing the intermediate roll during rolling in the horizontal and vertical direction.

9. Six-high rolling mill stand according to claim 1, wherein at least two stabilising devices are assigned to each work roll for stabilizing the work roll during rolling in the horizontal and vertical direction.

10. Finishing mill train for hot rolling an intermediate strip into a thin strip, wherein the thickness of the thin strip is <0.8 mm, the finishing mill comprising:

two or three four-high mill stands, wherein each four-high mill stand features work roll bending blocks for bending the work rolls of the mill stand in the vertical direction, two or three six-high rolling mill stands according to claim 1, wherein the four-high mill stands are arranged in the transport direction of the strip before the six-high rolling mill stands.

11. Finishing mill train according to claim 10, additionally comprising:

a cooling line for cooling the thin strip to coiling temperature, a measurement device for measuring the profile and/or the flatness of the thin strip, wherein the measurement device is arranged in the transport direction of the strip between the last mill stand of the finishing mill train and the first cooling header of the cooling line.

12. Finishing mill according to claim 11, additionally comprising:

a controller for controlling the profile and/or flatness of the thin strip, wherein the controller is connected to the measurement device for measuring the profile and/or the flatness of the thin strip, the work roll bending blocks of the four-high mill stands of the finishing mill train, and the work roll bending blocks and the intermediate roll bending blocks of the six-high mill stands of the finishing mill train.

13. Finishing mill according to claim 12, wherein the controller is also connected to the work roll cooling devices for cooling multiple, axially spaced cooling zones (Z1 . . . Z12) of the running surface of a work roll with adjustable cooling intensity.

14. Method for producing a thin strip in a combined casting and rolling installation, wherein the thickness of the thin strip is <0.8 mm, comprising the following steps:

continuous casting a steel strand with slab or thin-slab format in a continuous casting machine;

liquid-core reduction and/or soft-core reduction of the steel strand in a strand guide of the continuous casting machine, wherein the thickness of the steel strand is reduced by at least 5%;

roughing rolling of the reduced steel strand to an intermediate strip in a roughing mill train, wherein the thickness of the intermediate strip is between 8 and 45 mm;

finishing rolling the intermediate strip into the thin strip in a finishing mill train, wherein firstly two or three reduction steps are performed subsequently by four-high mill stands, and secondly, two or three reduction steps are performed subsequently by six-high mill stands, wherein the finishing mill train is according to claim 10;

measuring a profile and/or a flatness of the thin strip, wherein a measurement device is arranged in the transport direction of the strip between the last mill stand of the finishing mill train and the first cooling header of a cooling line;

cooling of the thin strip to coiling temperature in the cooling line; and coiling of the cooled thin strip.

15. Method according to claim 14, wherein the roughing rolling is performed on an uncut steel strand, the finishing rolling is performed on an uncut intermediate strip.

16. Method according to claim 15, wherein the cooling is performed on the uncut thin strip, and the thin strip is cut before the coiling of the cooled thin strip.

17. Method according to claim 14, wherein the steel strand is cut to slabs before roughing rolling, roughing rolling the slabs into intermediate strips, wherein the intermediate strips are joined together before finishing rolling, finishing rolling is performed on the joined intermediate strips.

18. Method according to claim 17, wherein the cooling is performed on the uncut thin strip, and the thin strip is cut before the coiling of the cooled thin strip.

19. Method according to claim 14, wherein the profile and/or the flatness of the thin strip is controlled by a controller taking into account the measured profile and/or flatness of the thin strip by setting the bending of the work rolls of the four-high mill stands of the finishing mill train, the bending of both the work rolls and the intermediate rolls of the six-high mill stands of the finishing mill train, and cooling of multiple, axially spaced cooling zones (Z1 . . . Z12) of the running surface of the work rolls of the six-high mill stands of the finishing mill train with a pre-set cooling intensity.

20. Method for producing a thin strip in a combined casting and rolling installation according to claim 11, additionally comprising heating the intermediate strip to a surface temperature between 90° and 1200° C.

* * * * *